United States Patent [19]

Giles

[11] 4,291,868

[45] Sep. 29, 1981

[54] CLAMPING APPARATUS FOR WORK TABLE

[76] Inventor: Barry R. Giles, 1209 Burnside West, Victoria, B. C., Canada, V8Z 1N7

[21] Appl. No.: 101,809

[22] Filed: Dec. 10, 1979

[51] Int. Cl.[3] ..... B25B 1/06

[52] U.S. Cl. ..... 269/93; 269/54; 269/152; 269/164; 269/167; 269/170

[58] Field of Search ..... 269/91, 154, 166–170, 269/218, 216, 224, 164, 203, 54, 54.1, 221, 93; 144/281; 254/69, 106; 100/224–226

[56] References Cited

U.S. PATENT DOCUMENTS

| | | | |
|---|---|---|---|
| 677,818 | 7/1901 | Thompson . | |
| 836,303 | 11/1906 | Christensen . | |
| 1,020,129 | 3/1912 | Crandal . | |
| 1,173,760 | 2/1916 | Williams | 269/54 |
| 2,323,654 | 7/1943 | Gordy et al. | 269/224 |
| 2,581,040 | 1/1952 | Mullenback | 269/154 |
| 2,605,795 | 8/1952 | Tracy | 269/164 |
| 2,716,536 | 8/1955 | Gonzales | 254/106 |
| 3,091,432 | 5/1963 | Chartier | 254/106 X |

FOREIGN PATENT DOCUMENTS

| | | | |
|---|---|---|---|
| 27395 | 10/1916 | Norway | 254/54 |

*Primary Examiner*—Robert C. Watson
*Attorney, Agent, or Firm*—Carver & Co.

[57] ABSTRACT

Clamping apparatus for clamping a work piece onto a work table remote from the edges of the work table. Apparatus includes a main support member and first and second engaging members spaced along and extending from the support member so that outer ends of the engaging members cooperate with the work table. Jacking apparatus cooperates with one of the engaging members to move the engaging member relative to the support member. This clamps the work piece onto the work table with a clamping surface associated with the main support item. Each engaging means can be quickly adjusted to accommodate work pieces and work tables of different depths. The clamping surface can be resiliently mounted relative to the support member to increase versatility of clamping apparatus.

11 Claims, 6 Drawing Figures

CLAMPING APPARATUS FOR WORK TABLE

BACKGROUND OF THE INVENTION

1. Field of the Invention

The invention relates to a clamping apparatus for clamping work pieces onto a work table such as a woodworking bench or work table of a machine tool.

2. Prior Art

Many clamping devices are available for woodworking, such as the common woodworking vise secured to a front edge of a work bench. Whilst the vise is probably one of the more useful fixed clamping devices, it has many limitations, particularly when clamping large items beyond the capacity of the vise. To the inventor's knowledge, there are only a few common methods of clamping a work piece onto a horizontal working surface of the bench, and commonly these devices are limited in their application, both for the size of the work piece and the size of the bench. Whilst G-clamps are effective for some applications, they are limited in their ability to clamp an item remote from edges of the work bench due to insufficient reach or throat of the clamp. Thus, if an item is to be clamped remote from edges of the work bench, difficulty can be encountered unless the item can be screwed or secured by other means to the work bench, which would tend to deface the item. Furthermore, with clamping devices using screw threaded members, such as vises and G-clamps, unless thread disengaging means are employed, considerable time can be spent rotating the threaded member to adjust the clamping device from one extreme size to the opposite extreme size.

SUMMARY OF THE INVENTION

The invention reduces difficulties and disadvantages of the prior art by providing a clamping apparatus which can clamp items to a work table remote from edges of the work table without requiring screws or other means which might deface the item. Furthermore, the clamping apparatus is adjustable to accomodate work tables of different widths and thicknesses. Also, considerable clamping pressure can be applied by a jacking means which quickly and easily clamps an item to the work table, after which the item can be readily unclamped. One embodiment of the jacking means does not use screw threaded devices and thus adjusts relatively quickly to accomodate work pieces of different thicknesses.

A clamping apparatus according to the invention includes a main support member being a generally straight bar, and a jaw member movable longitudinally of the bar and having a clamping surface adapted to contact the item, first and second engaging members and a jacking means cooperating with the first engaging member. The engaging members extend from positions spaced along the support member, each engaging member having, adjacent at an outer end thereof, holding means to cooperate with the work table. The jacking means is lever actuated and has a reciprocable jacking member adapted to engage the first engaging member to move the first engaging member relative to the support member to clamp the item between the clamping surface and the work table. The jacking member also is disengagable from the engaging member to permit quick adjustment of the engaging member relative to the support member to accommodate quickly items of widely differing sizes.

The clamping apparatus as above can be further modified by eliminating the movable jaw member on the bar or support member and substituting the clamping surface of the support member, with a further modification relating to a clutch means cooperating with the second member. The clutch means would include a perforated clutch member resiliently mounted relative to the support member, the clutch member having an opening therein complementary to the second engaging member. The opening has a size sufficient to permit sliding between the clutch member and the engaging member when axes of the opening and engaging members are generally aligned, and yet to prevent essentially such relative movement when the axes are sufficiently non-aligned. The opening of the clutch member has relatively sharp edges, at least one of which engages the engaging member when the axes are sufficiently non-aligned to serve as a dog to essentially prevent the relative movement therebetween. Furthermore, a resilient spacer is sandwiched between the clutch member and the support member, the clutch member then being inclined to the engaging member when engaged and relatively loosely secured to the support member when disengaged so as to permit rocking of the clutch member relative to the support member to permit engagement and disengagement of the clutch member.

A detailed disclosure following, related to drawings, describes a preferred embodiment of the invetion which is capable of expression in structure other than that particularly described and illustrated.

DETAILED DISCLOSURE

Figures 1, 3, 4, 5, 6:
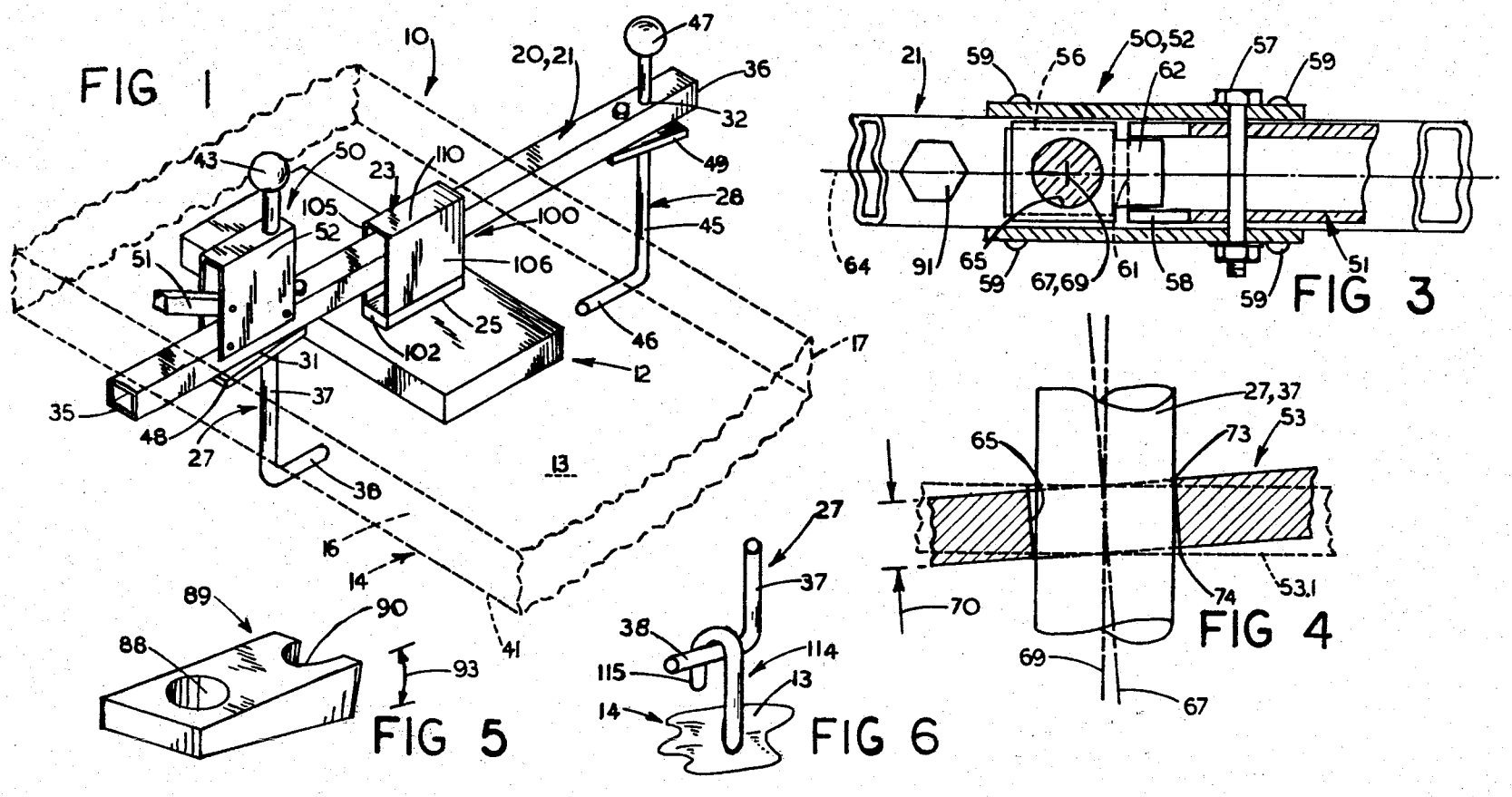
FIG. 1 is a simplified fragmented perspective of a clamping apparatus according to the invention engaging a work table and clamping an item onto an upper surface of the work table.
FIG. 3 is a simplified section on line 3—3 of FIG. 2 showing jacking means according to the invention.
FIG. 4 is a fragmented side elevation of jacking means in two positions.
FIG. 5 is a perspective of a portion of a clutch means.
FIG. 6 is a fragmented perspective showing alternative restraining structure for the apparatus.
Figure 2:
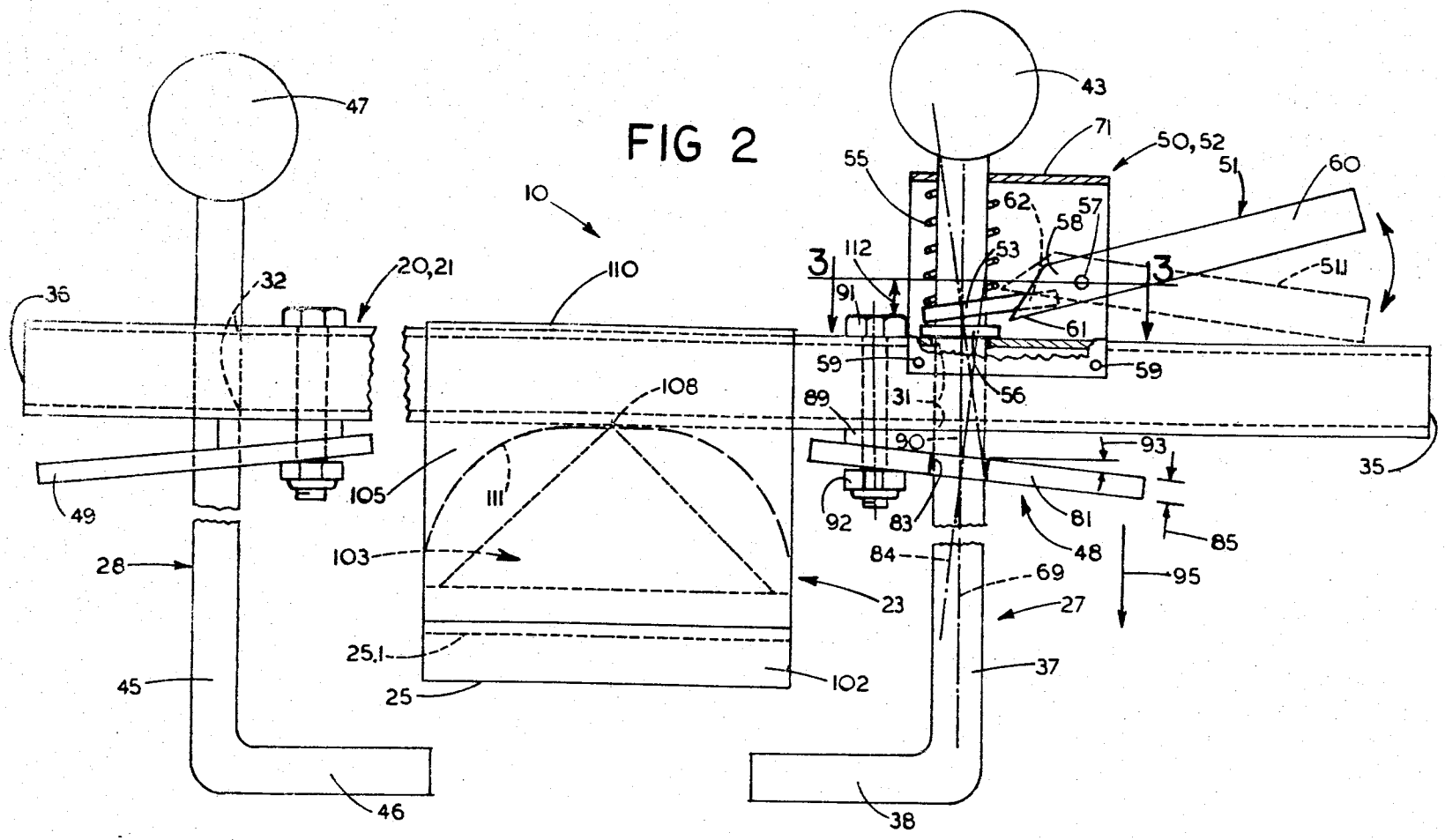
FIG. 2 is a simplified fragmented side elevation of the clamping apparatus of FIG. 1, some portions being removed to show internal detail.

FIGS. 1 and 2

A clamping apparatus 10 according to the invention is shown clamping an item 12 onto an upper surface 13 of a work table 14. The item 12 is typically a work piece of wood being planed, chiselled or worked on with other tools, and the work table 14 is typically a woodworking bench having opposite side edges 16 and 17, all being shown in broken outline.

The clamping apparatus 10 has a main support member 20 which is a generally straight bar 21, preferably square sectioned as shown for reasons to be described. A jaw member 23 is movable longitudinally of the bar and has a lower surface 25 which serves as a clamping surface adapted to contact the item.

The clamping apparatus includes first and second engaging members 27 and 28 extending from positions spaced along the support member. The support member has openings 31 and 32 to receive the engaging members 27 and 28 respectively, the openings being adjacent each end 35 and 36 respectively of the support member. The engaging member 27 is L-shaped and has a leg portion 37 adapted to pass through the opening 31, and an inwardly inclined foot portion 38 adapted to engage a lower surface 41 of the work table 14. The engaging member 27 has a lift knob 43 at an upper end thereof for gripping by an operator to pull or push the engaging member laterally relative to the support member. The engaging member 28 is generally similar and has a leg portion 45, a foot portion 46 and a lift knob 47. Both engaging members have approximately equal lengths to accomodate anticipated maximum depth of both the item 12 and the work bench 14. It can be seen that the inwardly inclined foot portions 38 and 46 serve as holding means to engage the surface 41 of the work table which is remote from the item to be clamped, or other structure associated with the work table, as will be described. Thus, each engaging member has adjacent an outer end thereof holding means to cooperate with the work table. Means other than the foot portions can be substituted, for example expansion bolt means might be fitted within an opening within the work table remote from the edges thereof so as to permit gripping of an item when edges of the work table cannot be gripped by external engaging means.

First and second clutch means 48 and 49 fitted adjacent opposite ends of the support member cooperate with the first and second engaging members 27 and 28 respectively. A jacking means 50 has a housing 52 which cooperates with the first engaging member 27 and the support member and includes a jacking lever 51 and is described with reference to FIGS. 2 and 3.

FIGS. 2 through 5

Referring mainly to FIG. 2, the jacking means 50 also includes a jacking plate 53, a jacking spring 55 and a square spacer washer 56. The housing 52 has two open ends and is an inverted U-shaped sheet member and is secured to the support member by fasteners 59. The jacking lever 51 is hinged to the housing by a hinge pin 57 to journal the jacking lever for rocking movement relative to the housing between a raised position in full outline and a lowered position in broken outline 51.1. Thus, the jacking lever is hinged relative to the support member for swinging movement relative thereto. The jacking lever is a square-sectioned tube of similar cross section as the member 20 so as to fit easily within the housing 52. The lever 51 has inner and outer portions 58 and 60 respectively, and the inner portion 58 is tapered to provide a lip 61 straddled by side walls of the lever, and is disposed within the housing to cooperate with a tang 62 of the jacking plate 53. The outer portion 60 is disposed symmetrically about a central plane 64 containing the support member so that the outer portions of the jacking lever and support member can be gripped in the hand for squeezing towards each other and releasing, causing the rocking movement as described.

Referring mainly to FIG. 4, the jacking plate 53 has an opening 65 therein generally complementary to the first engaging member 27. The opening is of a size sufficient to permit relative sliding between the plate and engaging member when the opening and engaging member are aligned. That is, relative sliding can occur when an axis 67 of the opening and an axis 69 of the first member 27 are generally aligned, ie. the plate 53 is normal to the member 27 as shown in FIG. 4 in broken outline at 53.1. The jacking plate 53 is a hardened steel plate and has a thickness 70. The opening 65 has upper and lower edges 73 and 74 respectively which are spaced apart by the thickness 70 and are relatively sharp edged so as to bit into the engaging member 27 for gripping. Thus, the plate 53 has sufficient thickness and the clearance of the engaging member in the opening 65 is such that, when the axes are sufficiently non-aligned, as shown in full outline in FIGS. 2 and 4, the relative movement aforesaid is essentially prevented.

The spacer washer 56 fits under the jacking plate to provide clearance for the lip 61 of the jacking lever 51 and to permit rocking movement of the jacking lever relative to the support member. The jacking spring 55 is a coil spring which encircles the engaging member 27 and extends between an upper portion 71 of the housing and the jacking plate 53 so as to force the jacking plate onto the spacer washer and the support member. It can be seen that the jacking plate is thus perforated and is resiliently mounted relative to the support member. Furthermore, the jacking plate cooperates with the jacking lever so that swinging the jacking lever causes the jacking plate to rock relative to the support member.

Referring mainly to FIGS. 2 and 5, the first clutch means 48 cooperates with the first engaging member 27 as follows. The clutch means 48 includes a clutch member 81 having an opening 83 therein complementary to the first engaging member. The opening 83 is of a size sufficient to permit relatively easy sliding between the clutch member 81 and the engaging member when the member 81 is normal to the member 27, ie. an axis 84 of the opening 83 is aligned with the axis 69 of the member 27, which condition is not shown. The clutch member 81 is a hardened steel plate having a thickness 85 sufficient to prevent such movement when the axes are sufficiently non-aligned, as seen in FIG. 2, and thus functions in a manner somewhat similar to the jacking plate 53. The opening 83 thus has relatively sharp undesignated upper and lower edges which engage the engaging member when the axes are sufficiently non-aligned to serve as a dog clutch to essentially prevent relative movement therebetween. As best seen in FIG. 5, a resilient tapered spacer 89 is sandwiched between the clutch member and the support member, and has a semi-circular cut-out 90 adjacent a thick end to accept approximately half of the periphery of the engaging member 27 therein. The spacer 89 also has an opening 88 adjacent a thin end to accept a bolt 91 passing through clearance openings in the main support member 20 and the clutch member 81. The bolt is secured with a self-locking nut 92 so that the clutch member is relatively loosely secured to the support member when disengaged to permit limited rocking of the clutch member relative to the support member in a manner somewhat similar to the jacking means. The resilient spacer 89 is tapered so that two opposite faces are inclined at an angle 93. Thus, when the spacer is unrestrained, the clutch member 81 is inclined at the angle 93 to the support member, and thus is inclined to the engaging member also. This inclination causes the edges of the opening 83 to engage the engaging member and prevent movement of the member 27 in direction of an arrow 95. If movement in the direction of the arrow 95 occurred, the angle 93 would tend to increase, thus increasing gripping. Thus, the clutch means is actuated in such a manner that a force acting against the gripping force tends to increase grip, thus making the clutch self-actuating.

Thus, it can be seen that the clutch means has a perforated clutch member resiliently mounted relative to the support member so that, when relaxed, the clutch member engages the engaging member so as to resist movement in direction of the arrow 95. This arrow represents direction of a reaction force on the member 27 resulting from the clamping. If the clutch member swings towards the member 20 tending to become parallel thereto, the angle 93 would be reduced which would then permit movement opposite to the arrow 95. Thus, it can be seen that, to disengage the clutch means, the clutch member 81 can be squeezed towards the support member 20, which causes the axes 84 and 69 to approach alignment for disengagement. Alternatively, the member 27 can be moved a little in the direction opposite to the arrow 95, which results in similar swinging of the clutch member which is instantaneously engaged with the member 27. Thus a particular relative movement between the members 81 and 27 caused by either of two actions above alters the relative positions therebetween and disengages the clutch, thus permitting longitudinal movement of the member 27 relative to the support member. As will be described, rocking the jacking lever and the plate 53 causes an upwards movement of the member 27 in a direction opposite to the arrow 95, which releases the clutch means 48 for the full upward stroke, permitting relatively free upwards movement of the member 27. When the upwards stroke is finished, the member 27 tends to start to move downwards but is automatically re-engaged by the clutch means 48 in response to this downward movement. Thus the clutch means reduces movement of the member 27 when unrestrained by the jacking means 50.

The second clutch means 49 cooperates with the second engaging member 28 in a manner generally similar to the first clutch means 48 and is not described in detail. Clearly only one engaging member requires a jacking means as the remaining engaging member can be positioned at the required setting by disengaging the respective clutch means and moving the engaging member as required by the lift knob.

FIGS. 1 and 2

The jaw member 23 has a generally inverted U-sectioned body member 100 secured to a spacer member 102 having the lower surface 25 which serves as the clamping surface. A resilient, triangular-shaped block 103, suitably formed of soft rubber or other elastomeric compound, is fitted between side portions 105 and 106 of the body. The block has an apex 108 spaced from an upper portion 110 of the body by a distance somewhat less than depth of the bar 21. Thus, when the support member 20 is fitted between the block 103 and the upper portion 110, the apex 108 lightly touches the member 20 and the block is deformed slightly so as to prevent sliding under its own weight along the clamping bar, and yet permitting easy manual sliding along the bar 21 to a desired position relative to the engaging members. In effect, the body has an opening to receive the support member inserted therethrough to permit moving of the jaw member along the support member.

Clamping force is determined mostly by deformation of the block 103 under the action of the forces generated by the jacking means 50. As forces increase, the block can deform to a shape 111, broken outline, as the clamping surface 25 assumes a different position 25.1. Clearly, other resilient means cooperating with the clamping surface to provide a resilient clamping surface can be substituted. Alternatively, the resilient aspect can be eliminated completely.

OPERATION

In operation, the item 12 to be clamped is placed on the surface 13 of the work table 14 and the jaw member is to engage the item's upper surface. The second clutch means 49 is released from the engaging member 28 to permit the knob 47 to be gripped to pull the foot portion 46 against the lower surface 41 of the work table. Simultaneously, this pulling draws the support member downwardly so as to compress somewhat the resilient block 103 of the jaw member 23, thus preventing further movement. The first clutch means 48 is similarly disengaged permitting the engaging member 27 to be similarly pulled upwards by the knob 43 to draw the support member 20 further towards the work table, further compressing the resilient block 103. The first clutch means is then released and the jacking lever 51 is now gripped and drawn downwardly towards the bar 21, and is then released alternately in an oscillating manner. This reciprocating "jacking" draws the engaging means relative to the support member, thus tightening grip on the item between the jaw member 23 and the table 14.

A more detailed description of the jacking now follows. When the lever 51 swings to the broken outline position 51.1, the edges 73 and 74 of the opening in the plate 53 engage the engaging member 27 and force the members upwards a distance 112, which approximates to sweep or stroke of the inner portion 58. The upwards movement of the member 27 simultaneously releases the first clutch means 48 which, when the stroke is finished, permits the member 27 to move downwards a little which causes the clutch means to re-engage automatically the member 27. Thus, when the lever 51 attains the position 51.1, it is limited by interference with the support member 20, and when it starts to swing back to the full outline position as shown, the grip of the plate 53 is released from the engaging member 27. When released, the member 27 moves per arrow 95 an amount which causes the first clutch means essentially simultaneously to engage the engaging member and prevent further movement per the arrow 95. Thus, a grip is maintained on the engaging member by the clutch means until a second stroke of the jacking lever towards the support member disengages the clutch means and draws the engaging member in a direction opposite to the arrow 95.

Thus, it can be seen that the first clutch means and jacking means alternately engage and disengage from the first engaging member, resulting in incremental movement of the engaging member with corresponding incremental compression of the block 103, which increases gripping force between the jaw member 23 and the work table.

ALTERNATIVES AND EQUIVALENTS

Clearly, other jacking means can be substituted for the means 50, as could other clutch means be substituted for the clutch means 48 and 49. Clearly, two jacking means can be used, one for each engaging member, but this is unnecessary for most applications. Furthermore, additional openings can be provided in the bar 21 to accept the member 28 and associated bolt to permit variation of spacing between the members 27 and 28 to accomodate work tables of different widths. The jacking means 50 is a lever actuated jacking means having a reciprocable jacking member to engage the engaging means to move the engaging means relative to the support member. The means 50 is also disengagable from the engaging means to permit quick adjustment of the engaging member relative to the support member to accommodate quickly items of widely differing sizes. Whilst the jacking member is exemplified as the perforated jacking plate, equivalent reciprocable jacking members can be substituted.

FIG. 6

If it is inconvenient for the engaging means to grip the lower surface of the work table 14, a j-bolt 114 can be fitted to extend upwardly from the surface 13 of the table. The j-bolt has a curved outer end portion 115 which receives the foot portion 38 of the engaging member 27 to react against clamping forces. Other means to accept the foot portion 38 can be substituted for the j-bolt, thus permitting the holding means to cooperate with the work table in other ways.

I claim:

1. A clamping apparatus for clamping an item onto a work table, the apparatus including:

(a) a main support member being a generally straight bar, and a jaw member movable longitudinally of the bar and having a clamping surface adapted to contact the item, (b) first and second engaging members extending from positions spaced along the support member, each engaging member having adjacent an outer end thereof holding means to cooperate with the work table, (c) lever actuated jacking means having a reciprocable jacking member adapted to engage the first engaging member to move the first engaging member relative to the support member to clamp the item between the clamping surface and the work table, the jacking member also being disengagable from the engaging member to permit quick adjustment of the engaging member relative to the support member to accommodate quickly items of widely differing sizes.

2. A clamping apparatus for clamping an item onto a work table, the apparatus including:

(a) a main support member having a clamping surface adapted to contact the item, (b) first and second engaging members extending from positions spaced along the support member, each engaging member having adjacent an outer end thereof holding means to cooperate with the work table, (c) lever actuated jacking means having a reciprocable jacking member adapted to engage the first engaging member to move the first engaging member relative to the support member to clamp the item between the clamping surface and the work table, the jacking member also being disengagable from the engaging member to permit quick adjustment of the engaging member relative to the support member to accommodate quickly items of widely differing sizes, (d) a clutch means cooperating with the second member, the clutch means including a perforated clutch member resiliently mounted relative to the support member, the clutch member having an opening therein complementary to the second engaging member, and of a size sufficient to permit relative sliding between the clutch member and the engaging member when axes of the opening and the engaging member are generally aligned, and yet to prevent essentially such relative movement when the axes are sufficiently non-aligned, the opening of the clutch member having relatively sharp edges, at least one of which engages the engaging member when the axes are sufficiently non-aligned to serve as a dog to essentially prevent relative movement therebetween, (e) a resilient spacer sandwiched between the clutch member and the support member, the clutch member being inclined to the engaging member when engaged and relatively loosely secured to the support member when disengaged, so as to permit rocking of the clutch member relative to the support member to permit engagement and disengagement of the clutch member.

3. A clamping apparatus as claimed in claim 1 or 2 further characterized by:

(a) the support member has an opening adjacent each end thereof to receive the engaging member therein, (b) each engaging member is L-shaped and has a leg portion adapted to pass through the respective opening in the support member, and an inwardly inclined foot portion to serve as the holding means to cooperate with the work table.

4. Clamping apparatus as claimed in claim 2 further characterized by:

(a) the main support member is a generally straight bar, (b) a jaw member is movable longitudinally of the bar and has a surface to contact the item to serve as the clamping surface of the apparatus.

5. A clamping apparatus as claimed in claim 1 or 4 in which the jaw member is further characterized by:

(a) a body having an opening to receive the support member inserted therethrough, the body being movable along the support member.

6. A clamping apparatus as claimed in claim 1 or 5 in which the jaw member is further characterized by:

(a) a resilient means cooperating with the clamping surface which engages the item to provide a resilient clamping surface.

7. A clamping apparatus as claimed in claim 1 further characterized by:

(a) a clutch means cooperating with the second member, the clutch means including a perforated clutch member resiliently mounted relative to the support member, (b) the clutch member having an opening therein complementary to the second engaging member, and of a size sufficient to permit relative sliding between the clutch member and the engaging member when axes of the opening and the engaging member are generally aligned, and yet to prevent essentially such relative movement when the axes are sufficiently non-aligned.

8. A clamping apparatus as claimed in claim 7 in which the clutch means is further characterized by:

(a) the opening of the clutch member having relatively sharp edges, at least one of which engages the engaging member when the axes are sufficiently non-aligned to serve as a dog to essentially prevent relative movement therebetween.

9. Clamping apparatus as claimed in claim 8 in which the clutch means is further characterized by:

(a) a resilient spacer sandwiched between the clutch member and the support member, the clutch member being inclined to the engaging member when engaged and relatively loosely secured to the support member when disengaged, so as to permit rocking of the clutch member relative to the support member to permit engagement and disengagement of the clutch member.

10. A clamping apparatus as claimed in claim 1 or 2 in which the jacking means is further characterized by:

(a) a jacking lever hinged relative to the support member for swinging movement relative thereto, (b) the jacking member being a perforated jacking plate which is resiliently mounted relative to the support member and cooperates with the jacking lever so that swinging the jacking lever causes the jacking plate to rock relative to the support member, (c) the jacking plate having an opening therein generally complementary to the first engaging member and of a size sufficient to permit relative sliding between the jacking member and the first engaging member when axes of the opening and the first engaging member are aligned, and yet to essentially prevent such relative movement when the axes are sufficiently non-aligned.

11. A clamping assembly as claimed in claim 10 in which the jacking means is further characterized by:

(a) a housing carried on the support member, the housing cooperating with the jacking lever so as to journal the jacking lever for rocking movement relative thereto, (b) a spring means extending between the housing and the jacking plate so as to urge the jacking plate towards the support member, (c) the jacking lever has inner and outer portions, the inner portion being disposed within the housing to cooperate with the jacking plate, and the outer portion disposed about a plane containing the support member so that the outer portion of the jacking lever and support member can be gripped in the hand for squeezing towards each other and releasing, so as to rock the jacking plate to draw the engaging means relative to the support member.

* * * * *